US010969745B2

(12) United States Patent
Haemmerli et al.

(10) Patent No.: US 10,969,745 B2
(45) Date of Patent: Apr. 6, 2021

(54) PIEZOELECTRIC ELEMENT FOR AN AUTOMATIC FREQUENCY CONTROL CIRCUIT, OSCILLATING MECHANICAL SYSTEM AND DEVICE COMPRISING THE SAME

(71) Applicant: The Swatch Group Research and Development Ltd, Marin (CH)

(72) Inventors: Alexandre Haemmerli, Neuchatel (CH); Francois Gueissaz, Cormondreche (CH); Lionel Tombez, Bevaix (CH); Bernhard Schnyder, Leuzigen (CH); Silvio Dalla Piazza, St-Imier (CH)

(73) Assignee: The Swatch Group Research and Development Ltd, Marin (CH)

( * ) Notice: Subject to any disclaimer, the term of this patent is extended or adjusted under 35 U.S.C. 154(b) by 397 days.

(21) Appl. No.: 16/112,817

(22) Filed: Aug. 27, 2018

(65) Prior Publication Data

US 2019/0079460 A1 Mar. 14, 2019

(30) Foreign Application Priority Data

Sep. 14, 2017 (EP) ..... 17191147

(51) Int. Cl.
*G04C 3/04* (2006.01)
*G04B 17/06* (2006.01)
*G04B 17/22* (2006.01)

(52) U.S. Cl.
CPC ..... *G04C 3/047* (2013.01); *G04B 17/066* (2013.01); *G04B 17/227* (2013.01)

(58) Field of Classification Search
CPC ..... G04B 17/063; G04B 17/066; G04C 3/047
See application file for complete search history.

(56) References Cited

U.S. PATENT DOCUMENTS 3,781,955 A * 1/1974 Lavrinenko ..... H03H 9/545 29/25.35
4,435,667 A * 3/1984 Kolm ..... G01H 1/10 310/330
6,671,380 B2 * 12/2003 Chang ..... H04R 17/00 310/367

(Continued)

FOREIGN PATENT DOCUMENTS

CH 705 679 A2 4/2013

OTHER PUBLICATIONS

European Search Report dated Mar. 7, 2018 in European Application 17191147.2, filed on Sep. 14, 2017 ( with English Translation of Categories of Cited Documents).

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A piezoelectric element for an automatic frequency control circuit. The element includes a balance spring formed of a piezoelectric crystal strip, a first electrode connected to the automatic control circuit, and disposed on at least a first side of the strip, and a second electrode connected to the automatic control circuit and disposed on at least a second side of the strip. The first and second electrodes are placed on one portion or over the entire length of the balance spring in a predetermined angular distribution.

19 Claims, 4 Drawing Sheets

(56) References Cited

U.S. PATENT DOCUMENTS

| | | | | |
|---|---|---|---|---|
| 8,721,169 | B2 | 5/2014 | Schafroth | |
| 9,188,957 | B2 * | 11/2015 | Willemin | G04C 3/042 |
| 2013/0051191 | A1 | 2/2013 | Schafroth | |
| 2013/0107677 | A1 | 5/2013 | Willemin et al. | |
| 2014/0078870 | A1 * | 3/2014 | Kobayashi | H01L 41/09 368/47 |
| 2015/0036346 | A1 * | 2/2015 | Hessler | B81C 1/00595 362/259 |
| 2015/0234356 | A1 * | 8/2015 | Hessler | G04B 17/26 368/200 |

* cited by examiner

PIEZOELECTRIC ELEMENT FOR AN AUTOMATIC FREQUENCY CONTROL CIRCUIT, OSCILLATING MECHANICAL SYSTEM AND DEVICE COMPRISING THE SAME

This application claims priority from European Patent Application No. 17191147.2 filed on Sep. 14, 2017; the entire disclosure of which is incorporated herein by reference

FIELD OF THE INVENTION

The invention concerns a piezoelectric element for an automatic frequency control circuit.

The invention also concerns an oscillating mechanical system comprising the piezoelectric element and a balance.

The invention also concerns a device comprising the oscillating mechanical system and a circuit for automatic control of the oscillation frequency of the oscillating mechanical system.

BACKGROUND OF THE INVENTION

Piezoelectric elements are commonly used in the field of electromechanical systems, for example for making oscillators used as time bases, or for applications for mass, force, gyroscope sensors and many others.

In the field of horology, and particularly of mechanical or electromechanical watches, it is known to provide an oscillating mechanical system with a piezoelectric element. The oscillating mechanical system may typically comprise a balance, on which is mounted a balance spring, one end of which is secured to the rotating balance staff and the other end of which is secured to a fixed element of a bottom plate. The oscillation of the mechanical system is maintained via an energy source which is generally mechanical. This energy source may be, for example, a barrel driving a gear train with an escape wheel cooperating with a pallet lever. This rotating pallet lever for example actuates a pin secured in proximity to the rotating balance staff. The balance with the balance spring may thus form a regulating member of a timepiece movement. This oscillating regulating member determines the driving speed of the gear train with the escape wheel leading to the time indicator hands. The piezoelectric element may include the balance spring, on which it is known to deposit films of a (PZT type) piezoelectric material, for example on the internal and external surfaces of the spring. In this regard, JP Patent Application No 2002-228774 or EP Patent Application No 2 590 035 A1 can be mentioned. However, depositing such piezoelectric films over the entire length of the balance spring introduces an expensive extra step into the manufacture of the spring, which is a drawback.

In these two Patent Applications, control of the oscillation frequency of the balance combined with the piezoelectric balance spring is achieved by means of an automatic frequency control circuit. The electronic circuit may be powered directly by the alternating voltage generated by the piezoelectric element, which has been rectified and stored across a capacitor. To control the oscillation frequency, a comparison is made between a signal at a reference frequency provided by an oscillator stage and the alternating signal from the generator. On the basis of this comparison, a frequency adaptation signal is generated which, once applied to the piezoelectric element, allows a compressive or extension force to be generated on the element in order to brake or accelerate the oscillation of the oscillating mechanical system.

Another example of a device comprising an oscillating mechanical system provided with a piezoelectric element, and a circuit for automatic control of the oscillation frequency of the oscillating mechanical system is provided by WO Patent Application No 2011/131784 A1. According to a particular example embodiment of this device, the piezoelectric element includes a balance spring formed of a strip of piezoelectric material, a first electrode disposed on an inner side of the spring, and a second electrode disposed on an outer side of the spring. The electrodes are connected to the automatic frequency control circuit. However, one drawback of the proposed piezoelectric element is that the piezoelectric effect of the element cannot be used in a precise and optimum manner without considerably complicating the design of the system.

SUMMARY OF THE INVENTION

It is therefore an object of the invention to provide a piezoelectric element for an automatic frequency control circuit, which is simple to realize and allows the piezoelectric effect to be used in a precise and optimum manner, in order to precisely control the oscillation frequency of the oscillating mechanical system, and to overcome the aforementioned drawbacks of the state of the art.

To this end, the invention concerns a piezoelectric element for an automatic frequency control circuit, the piezoelectric element comprising:

- a balance spring formed of a strip of piezoelectric material;
- a first electrode, intended to be connected to the automatic frequency control circuit, and disposed on at least a first side of the strip of piezoelectric material;
- a second electrode, intended to be connected to the automatic frequency control circuit, and disposed on at least a second side of the strip of piezoelectric material;
- wherein the piezoelectric material is a piezoelectric crystal or a piezoelectric ceramic; and
- wherein the first and second electrodes are placed on one portion or over the entire length of the balance spring in a predetermined angular distribution.

Using a piezoelectric crystal for the balance spring makes it possible to make the piezoelectric element in a simple and economical manner, while maintaining good piezoelectric performance. Further, the particular arrangement of the first and second electrodes in a predetermined angular distribution over the spring allows the electrodes to collect part of the electrical charges generated by a mechanical stress, overcoming the problem of the change in polarity of the charges due to the change in crystal orientation of the piezoelectric crystal. This change in polarity of the charges occurs with periodic angular distribution in the balance spring. Indeed, the crystalline structure of the piezoelectric material induces a dependence of the piezoelectric coefficient on the orientation of the mechanical stress in a horizontal plane XY. In other words, depending on the direction of the stress in plane XY, the electrical charges created may be positive or negative, and their value comprised between a zero value and a maximum value, as illustrated, for example, in FIG. 2 in the case of quartz. As a result of the piezoelectric element according to the invention, the problem of positive and negative charges cancelling each other in each of the electrodes is overcome. In a non-limiting manner within the scope of the present invention, the piezoelectric crystal is, for example, a single quartz crystal.

According to a first embodiment of the invention, the first and second electrodes are disposed on one portion of an outer coil of the balance spring, said portion including one end of the balance spring and defining a predetermined angular sector. One advantage of this first embodiment is the simplicity of manufacture of the piezoelectric element, and in particular of its electrodes.

According to a second embodiment of the invention, the first electrode includes first portions disposed on the first side of the strip of piezoelectric material and second portions disposed on at least one side of the strip of piezoelectric material distinct from the first side; and the second electrode includes first portions disposed on the second side of the strip of piezoelectric material and second portions disposed on at least one side of the strip of piezoelectric material distinct from the second side. The first and second portions of the first electrode or second electrode respectively are alternately connected to each other in junction areas. The junction areas are distributed over the balance spring with a predetermined angular periodicity.

One advantage of this second embodiment is that it maximises collection of the electrical charges generated, and thus maximises the amount of electrical energy collected.

Advantageously, the piezoelectric element includes a first groove made in the first side of the strip of piezoelectric material, and a second groove made in the second side of the strip of piezoelectric material. The first electrode is at least partially disposed in the first groove, and the second electrode is at least partially disposed in the second groove. This makes it possible to increase the capacitive coupling between the electrodes, and thereby increase the piezoelectric performance of the element.

To this end, the invention also concerns an oscillating mechanical system for an automatic frequency control circuit, comprising a balance and a piezoelectric element, the piezoelectric element comprising:

- a balance spring formed of a strip of piezoelectric material;
- a first electrode, intended to be connected to the automatic frequency control circuit, and disposed on at least a first side of the strip of piezoelectric material;
- a second electrode, intended to be connected to the automatic frequency control circuit, and disposed on at least a second side of the strip of piezoelectric material;
- wherein the piezoelectric material is a piezoelectric crystal or a piezoelectric ceramic; and
- wherein the first and second electrodes are placed on one portion or over the entire length of the balance spring in a predetermined angular distribution.

To this end, the invention also concerns a device including the oscillating mechanical system and the circuit for automatic control of the oscillation frequency of the oscillating mechanical system, said automatic control circuit including an oscillator stage able to provide a reference signal, means for comparing the frequency of two signals, and a frequency adaptation unit connected to the piezoelectric element of the oscillating mechanical system and able to provide a frequency adaptation signal, wherein the piezoelectric element of the oscillating mechanical system is able to generate an alternating voltage at a frequency matching the oscillating mechanical system, the first and second electrodes of the piezoelectric element being connected to the automatic control circuit in order to receive the frequency adaptation signal from the frequency adaptation unit, on the basis of the result of a frequency comparison, in the frequency comparison means, between the alternating voltage and the reference voltage.

Specific embodiments of the device are defined in claims 16 and 17.

BRIEF DESCRIPTION OF THE DRAWINGS

The objects, advantages and features of the piezoelectric element for an automatic frequency control circuit, and of the oscillating mechanical system and of the device including the same will appear more clearly from the following description made with reference to at least one non-limiting embodiment, illustrated by the drawings, in which.

DETAILED DESCRIPTION OF THE INVENTION

In the following description, reference is made to a piezoelectric element for an automatic frequency control circuit, particularly a circuit for automatic control of the oscillation frequency of an oscillating mechanical system. All the electronic components of the automatic frequency control circuit that are well known to those skilled in the art in this technical field will be described only in a simplified manner. As described below, the automatic control circuit is mainly used for controlling the oscillation frequency of a balance on which is mounted the balance spring of the piezoelectric element. However, other oscillating mechanical systems may also be envisaged, but in the following description, reference will be made only to an oscillating mechanical system in the form of a balance on which is mounted the balance spring of the piezoelectric element.

Figure 1:
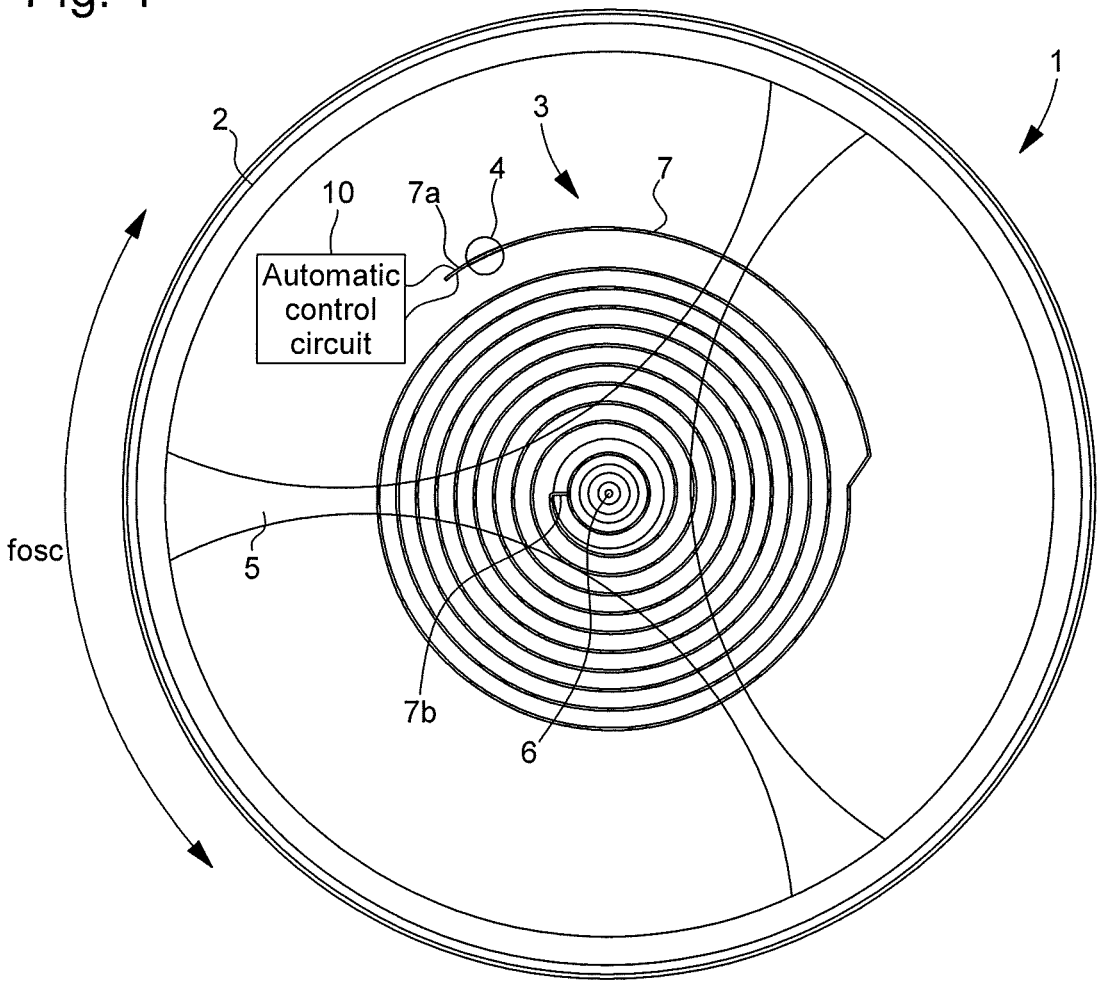
FIG. 1 shows a simplified view of a device, which includes an oscillating mechanical system provided with a piezoelectric element according to the invention, and a circuit for automatic control of the oscillation frequency of the oscillating mechanical system.

FIG. 1 shows a device 1, which includes an oscillating mechanical system 2, 3 and a circuit 10 for automatic control of the oscillation frequency fosc of the oscillating mechanical system. In a mechanical watch, the oscillating mechanical system may include a balance 2, which is formed of a metal ring connected, for example, by three arms 5 to a rotating staff 6, and a piezoelectric element 3, which includes a balance spring 7. As represented in FIGS. 3 to 8, piezoelectric element 3 further includes at least two electrodes 8*a*-8*d* electrically connected to automatic frequency control circuit 10. Returning to FIG. 1, a first end 7*a* of balance spring 7 is fixedly held by a balance spring stud 4 of a balance cock (not shown). This balance cock is secured to a bottom plate (not shown) of the watch movement. A second end 7*b* of balance spring 7 is directly secured to the rotating staff 6 of balance 2.

The oscillation of balance 2 with its balance spring 7 is maintained via an energy source (not shown), which may be electric, but is preferably mechanical. This mechanical energy source may be a barrel, which conventionally drives a gear train with an escape wheel cooperating with a pallet lever. This rotating pallet lever for example actuates a pin secured in proximity to the axis of rotation of the balance. The balance with the balance spring may thus form a regulating member of a timepiece movement.

Balance spring 7 is realized by means of a strip of piezoelectric material of thickness generally less than 0.25 mm, for example on the order of 0.1 to 0.2 mm. The piezoelectric material may be a piezoelectric crystal or a PZT piezoelectric ceramic. Preferably, the piezoelectric crystal is a single crystal, typically single crystal quartz, in the example embodiments of FIGS. 2 to 8. Balance spring 7 is, for example, machined in Z-cut single crystal quartz, in other words cut perpendicularly to the axis Z or optical axis of a single crystal quartz bar. A balance spring with coils spaced apart from one another made from a strip of piezoelectric material is obtained by micro-machining in a hydrofluoric acid bath, as described in US Patent Application No 2015/0061467 A1, which is incorporated herein by reference. At least two metal electrodes are deposited on at least two sides of the piezoelectric crystal strip, in an arrangement that will be described in more detail below. More specifically, the electrodes are placed on one portion or over the entire length of balance spring 7 in a predetermined angular distribution. Each electrode is, for example, an Au/Cr (Gold/Chromium) electrode.

Figure 2:
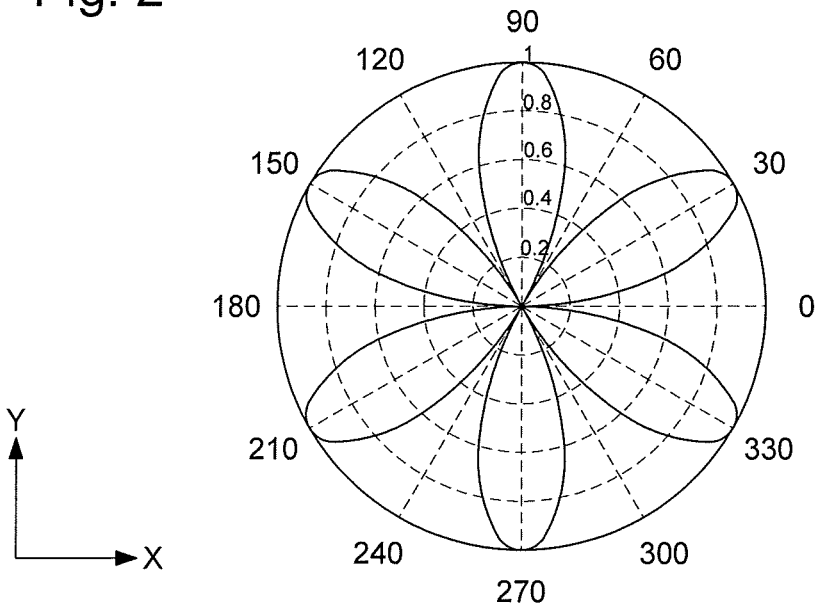
FIG. 2 is an amplitude diagram of the piezoelectric effect of the piezoelectric element according to an example embodiment of the invention, according to the orientation of a stress in a plane XY.

FIG. 2 represents the amplitude of the piezoelectric effect of element 3 when it includes a quartz balance spring 7, according to the orientation of a stress in a horizontal plane XY. As shown by this Figure, the crystalline structure of the quartz induces a dependence of the piezoelectric coefficient on the orientation of mechanical stress in plane XY. In other words, depending on the direction of the stress in plane XY, the electrical charges created by balance spring 7 may be positive or negative, and their value comprised between a zero value and a maximum value. Since the crystalline structure of quartz is trigonal, the maximum of the electrical charges is repeated every 60°, and there is also a change in polarity of the charges every 60°.

Figure 3:
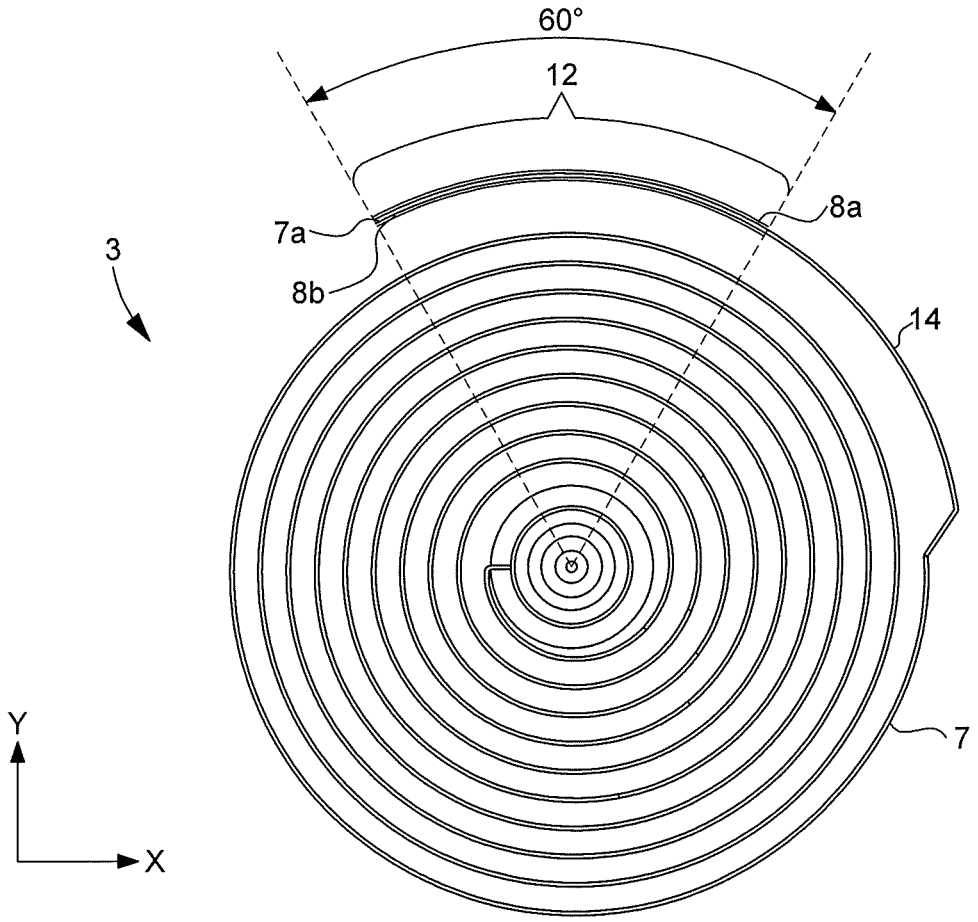
FIG. 3 represents the piezoelectric element according to a first embodiment of the invention.

A first embodiment of the invention will now be described with reference to FIGS. 3 and 4. According to this first embodiment, piezoelectric element 3 includes two electrodes 8*a*, 8*b*. The two electrodes 8*a*, 8*b* are disposed on one portion 12 of an outer coil 14 of balance spring 7. Portion 12 includes the first end 7*a* of balance spring 7 and defines a predetermined angular sector. In the preferred example embodiment wherein balance spring 7 is formed of a quartz strip, the predetermined angular sector is substantially equal to 60°. Thus, referring to FIG. 2, this first embodiment of the invention makes it possible to avoid the mutual cancellation of electrical charges, due to the change in polarity induced by the change in crystal orientation of quartz balance spring 7. Electrodes 8*a*, 8*b* collect part of the electrical charges induced by a mechanical stress, avoiding mutual cancellation of the charges.

Figure 4:
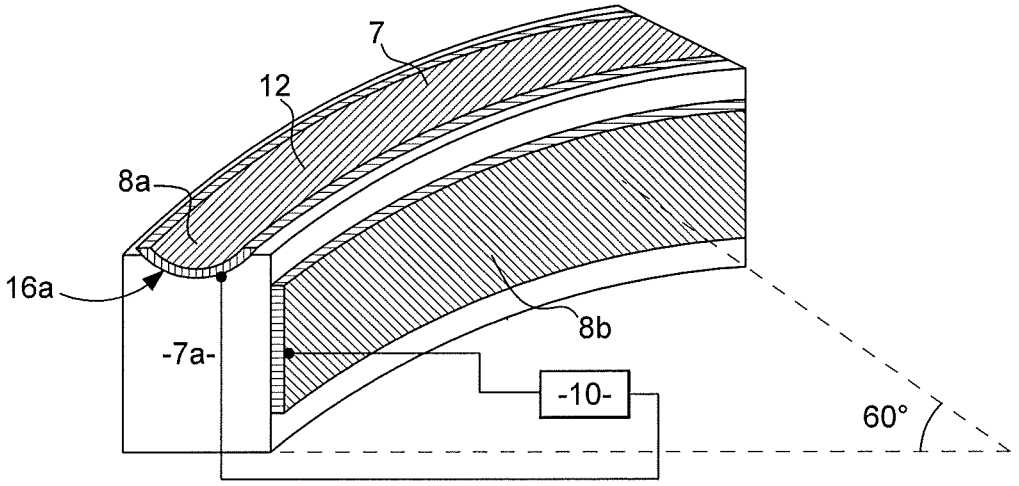
FIG. 4 represents a portion of an outer coil of a balance spring of the piezoelectric element of FIG. 3.

Preferably, as illustrated in FIG. 4, piezoelectric element 3 can include at least one groove 16*a* made in an upper face of the piezoelectric crystal strip denoted the 'upper side'. When the piezoelectric crystal strip with electrodes 8*a*, 8*b* is wound, the upper side bearing electrode 8*a* is that which is perpendicular to the axis of rotation of the balance parallel to the plane of the balance spring, whereas the inner side for electrode 8*b* is facing the axis of rotation of the balance. The first electrode 8*a* of the two electrodes is disposed in groove 16*a* of the upper side, and second electrode 8*b* is disposed on the inner side.

FIGS. 5 to 8 illustrate a second embodiment of the invention in which elements similar to the first embodiment described above are identified by the same references, and are not, therefore, described again.

Figure 5:
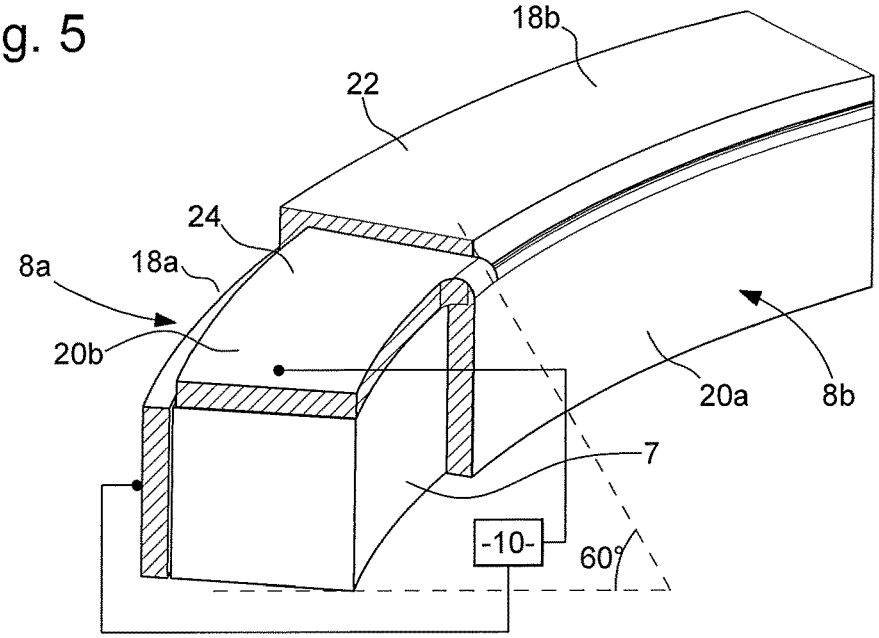
FIG. 5 represents a portion of a balance spring of the piezoelectric element according to a second embodiment of the invention, in a first alternative arrangement of electrodes on the balance spring.

According to a first variant embodiment represented in FIG. 5, a first electrode 8*a* of the two electrodes includes first portions 18*a* disposed on the outer side of the piezoelectric crystal strip, and second portions 18*b* disposed on a side of the strip denoted the 'upper side'. A second electrode 8*b* includes first portions 20*a* disposed on the inner side of the piezoelectric crystal strip, and second portions 20*b* disposed on the upper side. Preferably, the two electrodes 8*a*, 8*b* extend over the entire length of balance spring 7, although only one portion of the latter, and thus only one first portion 18*a*, 20*a* and one second portion 18*b*, 20*b* of each electrode 8*a*, 8*b*, are represented in FIG. 5.

First portions 18*a* and second portions 18*b* of first electrode 8*a* are alternately connected to each other in first junction areas 22. First portions 20*a* and second portions 20*b* of second electrode 8*b* are alternately connected to each other in second junction areas 24, adjacent to first junction areas 22. The first and second junction areas 22, 24 are distributed over balance spring 7 with a predetermined angular periodicity. Second portions 18*b*, 20*b* of first and second electrodes 8*a*, 8*b* extend in succession and alternately one after the other on the upper side of the piezoelectric crystal strip, with the same predetermined angular periodicity. In a variant that is not represented, second portions 18*b*, 20*b* of first and second electrodes 8*a*, 8*b* could extend in the same manner over one side of the piezoelectric crystal strip denoted the 'lower side'. In the preferred example embodiment wherein balance spring 7 is formed of a quartz strip, the predetermined angular periodicity is substantially equal to 60°.

Figure 6:
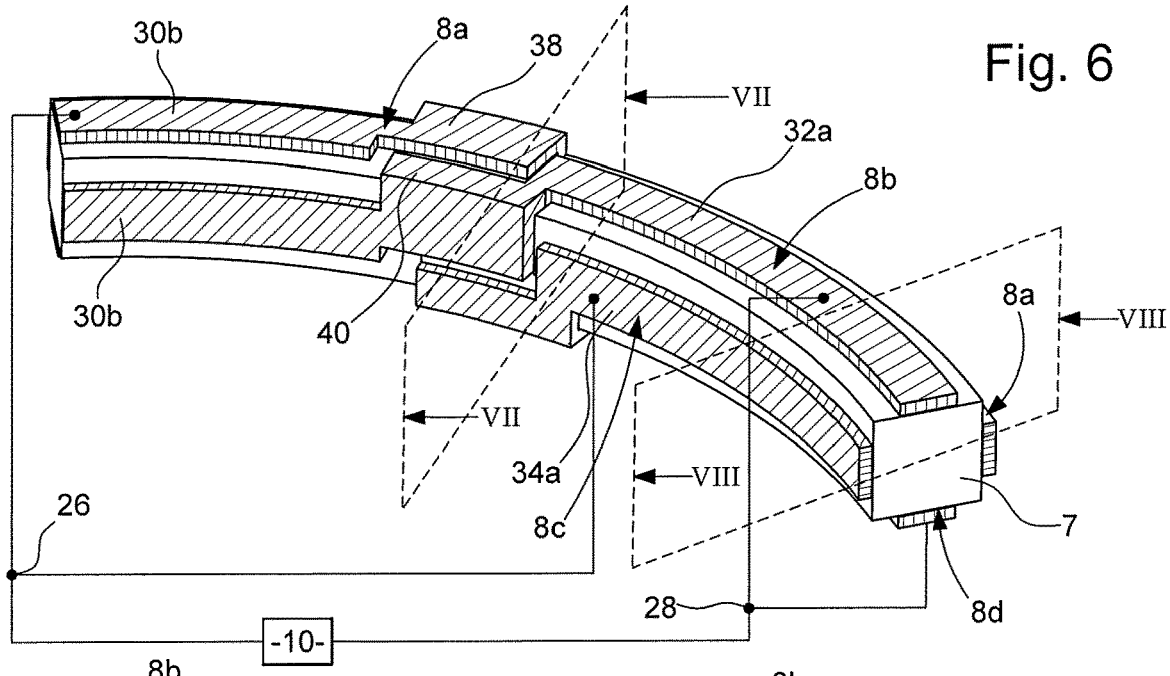
FIG. 6 represents a portion of a balance spring of the piezoelectric element according to the second embodiment of the invention, in a second alternative arrangement of electrodes on the balance spring.
Figure 7:
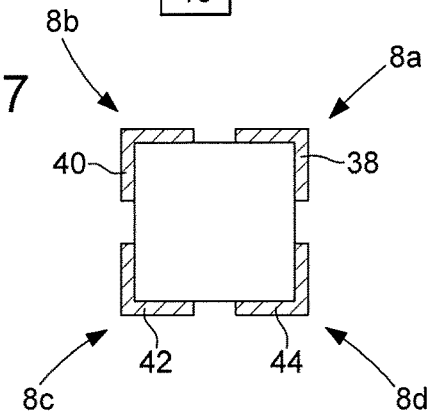
FIG. 7 is a cross-sectional view of the piezoelectric element of FIG. 6, taken along a cross-sectional plane VII-VII.
Figure 8:
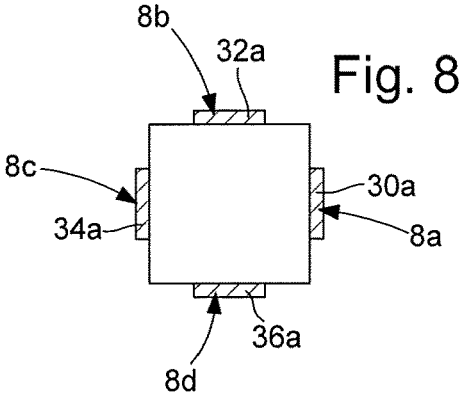
FIG. 8 is a cross-sectional view of the piezoelectric element of FIG. 6, taken along a cross-sectional plane VIII-VIII.

In a second variant embodiment represented in FIGS. 6 to 8, in addition to first and second electrodes 8*a*, 8*b*, piezoelectric element 3 also includes a third and a fourth electrode 8*c*, 8*d*. As illustrated in FIG. 6, third electrode 8*c*, which is of the same polarity as first electrode 8*a*, is connected to the latter in a first connection terminal 26. Fourth electrode 8*d*, which is of the same polarity as second electrode 8*b*, is connected to the latter in a second connection terminal 28. The first and second connection terminals 26, 28 are each connected to automatic frequency control circuit 10. In a particular example embodiment, not represented in the Figures, the first and second connection terminals 26, 28 are disposed on balance spring stud 4 which fixedly holds first end 7*a* of balance spring 7.

First electrode 8*a* includes first portions 30*a* disposed on the outer side of the piezoelectric crystal strip, and second portions 30*b* disposed on every side of the strip distinct from the outer side. Second electrode 8*b* includes first portions 32*a* disposed on the upper side of the piezoelectric crystal strip, and second portions 32*b* disposed on every side of the strip distinct from the upper side. Third electrode 8*c* includes first portions 34*a* disposed on the inner side of the piezoelectric crystal strip, and second portions disposed on every side of the strip distinct from the inner side. Fourth electrode 8*d* includes first portions 36*a* disposed on the lower side of the piezoelectric crystal strip, and second portions disposed on every side of the strip distinct from the lower side. Preferably, the four electrodes 8*a*, 8*b*, 8*c*, 8*d* extend over the entire length of balance spring 7, although only one portion of the latter is represented in FIG. 6. The second portions of third and fourth electrodes 8*c*, 8*d* are thus not visible in FIGS. 6 to 8.

First portions 30*a* and second portions 30*b* of first electrode 8*a* are alternately connected to each other in first junction areas 38. First portions 32*a* and second portions 32*b* of second electrode 8*b* are alternately connected to each other in second junction areas 40. First portions 34*a* and the second portions of third electrode 8*c* are alternately connected to each other in third junction areas 42. First portions 36*a* and the second portions of fourth electrode 8*d* are alternately connected to each other in fourth junction areas 44. The various junction areas 38-44 are distributed over balance spring 7 with a predetermined angular periodicity.

As illustrated in FIG. 7, each junction area 38-44 extends straddling two adjacent sides of the piezoelectric crystal strip. Thus, the first, second, third and fourth electrodes 8*a*, 8*b*, 8*c*, 8*d* extend in succession and alternately one after the other on each side of the piezoelectric crystal strip, with a predetermined angular sub-periodicity. In the preferred example embodiment wherein balance spring 7 is formed of a quartz strip, the predetermined angular sub-periodicity is substantially equal to 60°.

Referring to FIG. 2, this second embodiment of the invention makes it possible to avoid the mutual cancellation of electrical charges, due to the change in polarity induced by the change in crystal orientation of quartz balance spring 7. Through a periodic change of sides of the electrodes, the latter collect all of the electrical charges induced by a mechanical stress, avoiding mutual cancellation of the charges. In device 1 comprising oscillating mechanical system 2, 3, all of the electrical charges created by oscillating system 2, 3 are collected, thereby maximising the amount of electrical energy collected and provided to circuit 10.

Although not represented in FIGS. 5 to 8, the piezoelectric element 3 according to this second embodiment can advantageously include electrode support grooves, made in opposite sides of the piezoelectric crystal strip, which are the upper ad lower sides.

During the oscillation of balance 2 with balance spring 7, a compressive force or an extension force is alternately applied to the piezoelectric crystal strip, which together thus generate an alternating voltage. The oscillation frequency of balance 2 with balance spring 7 can typically be between 3 and 10 Hz. Automatic control circuit 10 thus receives this alternating voltage, via the electrodes to which it is connected. The automatic control circuit can be connected to the electrodes directly or via two metal wires.

Figure 9:
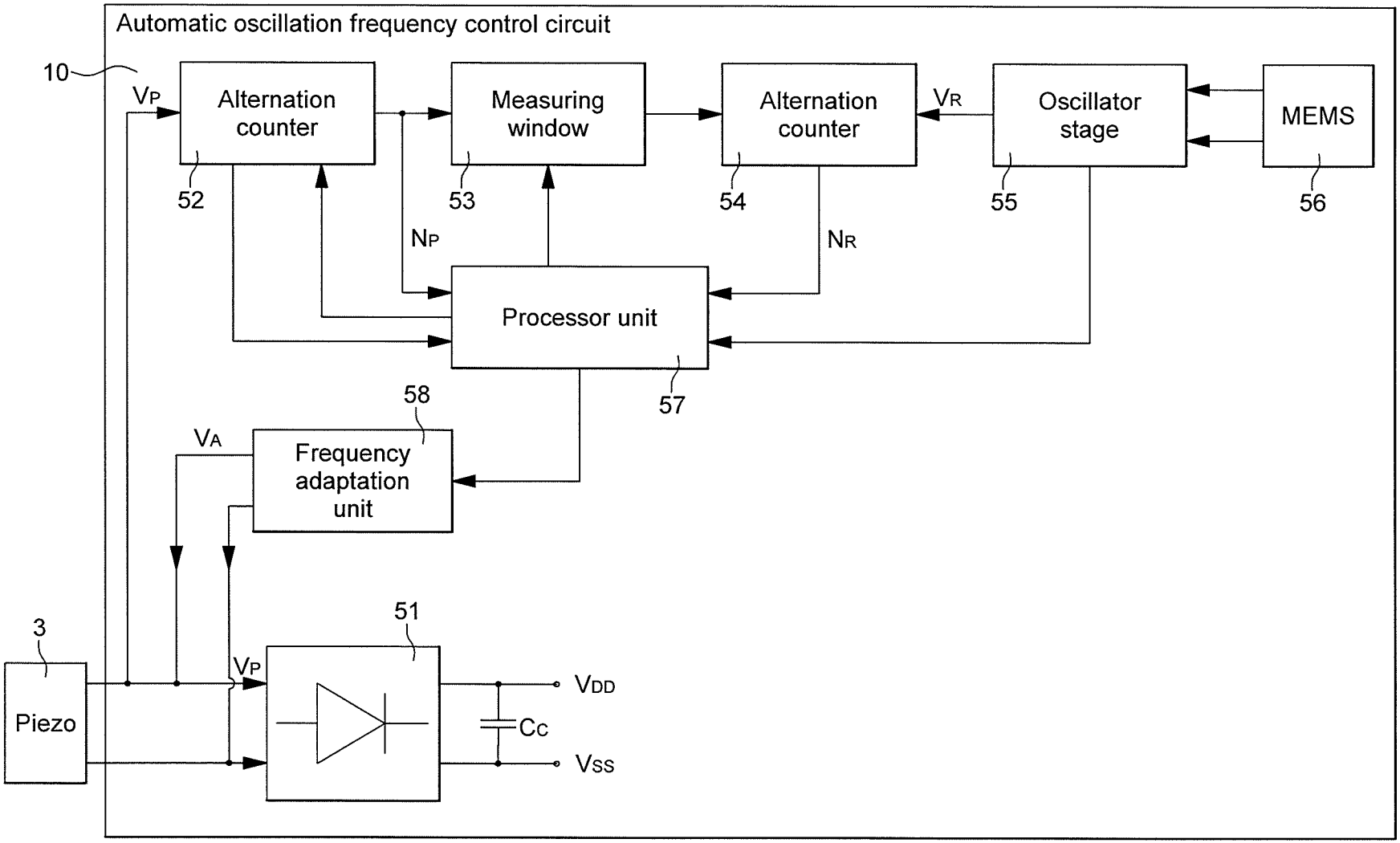
FIG. 9 represents a simplified block diagram of the electronic components of the automatic control circuit of FIG. 1, according to an example embodiment, wherein the circuit is connected to the piezoelectric element of the oscillating mechanical system.

FIG. 9 represents the various electronic elements of an example embodiment of automatic control circuit 10 for controlling the oscillation frequency of the oscillating mechanical system. Other examples of automatic frequency control circuits could be envisaged without departing from the scope of the invention.

Automatic control circuit 10 is connected to two electrodes or groups of electrodes of piezoelectric element 3. Automatic control circuit 10 is able to rectify the alternating voltage VP received from piezoelectric element 3 by means of a conventional rectifier 51. The rectified voltage of alternating voltage VP is stored across a capacitor Cc. This rectified voltage between terminals VDD and VSS of capacitor Cc may be sufficient to power all the electronic elements of the automatic control circuit without the aid of an additional voltage source, such as a battery or an energy conversion element, such as a solar cell, a thermoelectric generator or otherwise.

Automatic control circuit 10 includes an oscillator stage 55, connected, for example, to a MEMS resonator 56. The oscillating circuit of the oscillator stage with the MEMS resonator provides an oscillating signal, which may be of a frequency lower than 500 kHz, for example on the order of 200 kHz. Thus, oscillator stage 55 can preferably provide a reference signal VR, whose frequency may be equal to the frequency of the oscillating signal of the oscillator circuit.

In order to control the oscillation frequency of the oscillating mechanical system, a comparison must be made in automatic control circuit 10 between alternating voltage VP and reference signal VR. For this purpose, automatic control circuit 10 includes comparison means 52, 53, 54, 57 for comparing the frequency of alternating voltage VP to the frequency of reference signal VR. In the case where the reference signal frequency matches the frequency of the oscillation circuit of oscillator stage 55, i.e. a frequency on the order of 200 kHz, the comparison means must be designed to take account of the large frequency deviation between alternating voltage VP and reference signal VR.

The comparison means are formed, firstly, of a first alternation counter 52, which receives as input the alternating voltage VP of the piezoelectric element, and which provides a first counting signal NP to a processor processing unit 57. The comparison means also include a second alternation counter 54, which receives as input reference signal VR, and which provides a second counting signal NR to processor processing unit 57.

To take account of the frequency deviation between alternating voltage VP and reference signal VR, there is also provided a measuring window 53, disposed between first alternation counter 52 and second alternation counter 54. This measuring window 53 determines the counting time of second alternation counter 54. Processor processing unit 57 provides configuration parameters to measuring window 53 to determine the counting time for the second alternation counter. These configuration parameters are stored in a memory (not represented) in the processor processing unit. These configuration parameters may be different depending on whether the watch is a ladies' or men's watch. The different operations processed in processor processing unit 57 can be controlled by a clock signal provided, for example, by the oscillating circuit of oscillator stage 55.

The counting time of second alternation counter 54 is adapted proportionally to the counting time of a certain determined number of alternations counted by first alternation counter 52 in first counting signal NP. Processor processing unit 57 could also control first alternation counter 52 to define the beginning and end of a counting period. However, it is also possible to envisage that the first alternation counter 52 providing information as to the start and end of a determined number of counted alternations to processor processing unit 57. If, for example, there are 200 alternations to be counted in the first alternation counter, measuring window 53 is configured such that second alternation counter 54 counts a number of alternations of reference signal VR during a duration that is approximately 5000 times shorter. This duration may also be dependent on the counting time, for example, on the 200 alternations of first alternation counter 52. This makes it possible to reduce the electrical consumption of the automatic control circuit.

The start of counting controlled by measuring window 53 can be determined by first alternation counter 52 but can also preferably be directly controlled by processor processing unit 57. Processor processing unit 57 can first receive the first counting signal NP relating to a first determined number of counted alternations of alternating voltage VP in a first time interval. This first counting signal is stored, for example, in a register of the processor processing unit. Thereafter, processing unit 57 can receive the second counting signal NR relating to a second number of counted alternations in second alternation counter 54 in a second time interval controlled by measuring window 53. This second counting signal NR can also be stored in another register of the processor processing unit. Finally, a comparison of the two counting signals is made in processor processing unit 57 to determine whether the frequency of alternating voltage VP is proportionally too high or too low with respect to the reference signal frequency.

On the basis of the comparison made between the two counting signals NP and NR in the processor processing unit, said processor processing unit controls a frequency adaptation unit 58, whose output is connected to the two electrodes or electrode groups of piezoelectric element 3. This frequency adaptation unit 58 can be arranged to provide a frequency adaptation signal, which is a continuous signal VA, whose level is a function of the difference between the two counting signals communicated by the processor processing unit. A switchable array of capacitors or resistors can be provided for this purpose. A continuous voltage value can be provided via a voltage follower from adaptation unit 58 to one of the electrodes or groups of electrodes of piezoelectric element 3 or to the other electrode or group of electrodes of the piezoelectric element. This thus allows a certain force to be generated on the piezoelectric element in order to brake or accelerate the oscillation of the oscillating mechanical system as a function of the comparison of the two counting signals.

Automatic control circuit 10 may also include well known temperature compensating elements, and a unit for reset on each activation of automatic control circuit 10. All of the electronic components of the automatic control circuit, and MEMS resonator 56 and capacitor Cc form part, for example, of the same compact electronic module. All these electronic components can advantageously be integrated in the same monolithic silicon substrate, which makes it possible to have a single self-powered electronic module for controlling the frequency of the oscillating mechanical system.

The preceding description of the piezoelectric element according to the invention was made with reference to a balance spring formed of a single crystal quartz strip. However, the quartz used as piezoelectric crystal is not limiting within the scope of the present invention, and other piezoelectric crystals may also be envisaged for forming the balance spring, such as, for example, although this list is not exhaustive, topaz, berlinite, lithium niobate, lithium tantalate, gallium phosphate, gallium arsenate, aluminium silicate, germanium dioxide, a single crystal tourmaline, a single crystal from the group of zinc blende structure III-V semiconductors, or a single crystal from the group of wurtzite structure II-VI semiconductors.

Consequently, although the description of the invention given above was made with reference to a change in polarity of the charges observing a periodic angular distribution of 60°, due to the crystalline structure of quartz, other periodic angular distributions can also be envisaged without departing from the scope of the present invention defined by the claims, depending on the different types of piezoelectric crystals used to form the balance spring.

The two embodiments of the piezoelectric element according to the invention, described above for controlling the oscillation frequency of the oscillating mechanical system, can also advantageously be used to measure this oscillation frequency, and/or to make system phase corrections and/or to collect energy.

What is claimed is:

1. A piezoelectric element for an automatic frequency control circuit, the piezoelectric element comprising:

a balance spring formed of a strip of piezoelectric material;

a first electrode, intended to be connected to the automatic frequency control circuit, and disposed on at least a first side of the strip of piezoelectric material;

a second electrode, intended to be connected to the automatic frequency control circuit, and disposed on at least a second side of the strip of piezoelectric material;

wherein the piezoelectric material is a piezoelectric crystal or a piezoelectric ceramic;

wherein the first and second electrodes are placed on one portion or over the entire length of the balance spring in a predetermined angular distribution, wherein the first and second electrodes are disposed on one portion of an outer coil of the balance spring, said portion including one end of the balance spring and defining a predetermined angular sector, and wherein the first electrode includes first portions disposed on the first side of the strip of piezoelectric material and second portions disposed on at least one side of the strip of piezoelectric material distinct from the first side; wherein the second electrode includes first portions disposed on the second side of the strip of piezoelectric material and second portions disposed on at least one side of the strip of piezoelectric material distinct from the second side; the first and second portions of the first electrode respectively the second electrode being alternately connected to each other in junction areas; and wherein said junction areas are distributed over the balance spring with a predetermined angular periodicity.

2. The piezoelectric element according to claim 1, wherein the second portions of the first electrode and the second portions of the second electrode are disposed on a third side of the strip of piezoelectric material; and wherein said second portions of the first and second electrodes extend in succession and alternately one after the other on the third side of the strip of piezoelectric material, with said predetermined angular periodicity.

3. The piezoelectric element according to claim 2, wherein the electrodes are disposed over the entire length of the balance spring.

4. The piezoelectric element according to claim 1, wherein the element includes a third electrode and a fourth electrode; the third electrode being connected to the first electrode in a first connection terminal intended to be connected to the automatic frequency control circuit, the third electrode including first portions disposed on a third side of the strip of piezoelectric material and second portions disposed on at least one side of the strip of piezoelectric material distinct from the third side; the fourth electrode being connected to the second electrode in a second connection terminal intended to be connected to the automatic frequency control circuit, the fourth electrode including first portions disposed on a fourth side of the strip of piezoelectric material and second portions disposed on at least one side of the strip of piezoelectric material distinct from the fourth side; the first and second portions of the third electrode respectively the fourth electrode being alternately connected to each other in junction areas; and wherein said junction areas are distributed over the balance spring with said predetermined angular periodicity.

5. The piezoelectric element according to claim 4, wherein each second portion of the first, second, third, respectively fourth electrode extends over every side of the strip of piezoelectric material distinct from the first, second, third, respectively fourth side; and wherein the first, second, third and fourth electrodes extend in succession and alternately one after the other on each side of the strip of piezoelectric material, with a predetermined angular sub-periodicity.

6. The piezoelectric element according to claim 5, wherein the predetermined angular sub-periodicity encompasses an arc of the balance spring that is substantially equal to 60°.

7. The piezoelectric element according to claim 1, wherein the piezoelectric crystal is a single crystal.

8. The piezoelectric element according to claim 7, wherein the piezoelectric crystal is a single crystal chosen from the group consisting of topaz, berlinite, lithium niobate, lithium tantalate, gallium phosphate, gallium arsenate, aluminium silicate, germanium dioxide, a single crystal tourmaline, a single crystal from the group of zinc blende structure III-V semiconductors, or a single crystal from the group of wurtzite structure II-VI semiconductors.

9. The piezoelectric element according to claim 7, wherein the piezoelectric crystal is single crystal quartz.

10. The piezoelectric element according to claim 9, wherein the balance spring is machined in Z-cut single crystal quartz.

11. The piezoelectric element according to claim 1, wherein the predetermined angular sector encompasses an arc of the balance spring that is substantially equal to 60°.

12. The piezoelectric element according to claim 1, wherein the element further includes at least one groove made in the first upper or lower side of the strip of piezoelectric material, said first electrode being at least partially disposed in said groove, said second electrode being at least partially disposed on a second outer or inner side.

13. The piezoelectric element according to claim 12, wherein the groove is concave.

14. An oscillating mechanical system for an automatic frequency control circuit, comprising a balance and a piezoelectric element provided with a balance spring, the balance spring being mounted on said balance, wherein the piezoelectric element conforms to claim 1.

15. A device comprising the oscillating mechanical system according to claim 14 and a circuit for automatic control of the oscillation frequency of the oscillating mechanical system, said automatic control circuit including an oscillator stage able to provide a reference signal, means for comparing the frequency of two signals, and a frequency adaptation unit connected to the piezoelectric element of the oscillating mechanical system and able to provide a frequency adaptation signal, wherein the piezoelectric element of the oscillating mechanical system is able to generate an alternating voltage at a frequency matching the oscillating mechanical system, the first and second electrodes of the piezoelectric element being connected to the automatic control circuit in order to receive the frequency adaptation signal from the frequency adaptation unit, on the basis of the result of a frequency comparison, in the frequency comparison means, between the alternating voltage and the reference voltage.

16. The device according to claim 15, wherein the circuit for automatic control of the oscillation frequency of the oscillating mechanical system further includes a rectifier for rectifying the alternating voltage generated by the piezoelectric element and for storing the rectified voltage across at least one capacitor, in order to supply the automatic control circuit with electricity.

17. The device according to claim 15, wherein the oscillator stage of the automatic control circuit includes an oscillating circuit connected to a MEMS resonator to provide an oscillating signal, so that the oscillator stage provides the reference signal, all the electronic components of the automatic control circuit being grouped together to form a single electronic module.

18. The piezoelectric element according to claim 1, wherein a thickness of the strip of piezoelectric material is 0.1 to 0.2 mm.

19. The piezoelectric element according to claim 1, wherein the predetermined angular periodicity encompasses an arc of the balance spring that is substantially equal to 60°.

* * * * *